United States Patent [19]

Starrett

[11] Patent Number: 4,530,268

[45] Date of Patent: Jul. 23, 1985

[54] STRINGED MUSICAL INSTRUMENT

[76] Inventor: John D. Starrett, 7115 E. 14th Ave., Denver, Colo. 80220

[21] Appl. No.: 572,216

[22] Filed: Jan. 19, 1984

[51] Int. Cl.[3] ..... G10H 3/00

[52] U.S. Cl. ..... 84/1.16; 84/285; 84/DIG. 30

[58] Field of Search ..... 84/1.14, 1.15, 1.16, 84/284, 285, 289, DIG. 30, DIG. 24

[56] References Cited

U.S. PATENT DOCUMENTS

| | | | |
|---|---|---|---|
| 2,906,158 | 9/1959 | McBride | 84/285 |
| 3,668,295 | 6/1972 | Broussard | 84/1.15 |
| 3,715,446 | 2/1973 | Kosinski | 84/1.15 |
| 3,833,751 | 9/1974 | Chapman | 84/1.16 |
| 4,024,787 | 5/1977 | Larson | 84/1.16 |
| 4,156,380 | 5/1979 | Fulton | 84/171 |
| 4,249,449 | 2/1981 | Armstrong . | |

*Primary Examiner*—Forester W. Isen

*Attorney, Agent, or Firm*—Gregg I. Anderson

[57] ABSTRACT

A stringed musical instrument embodies a matrix of intersecting frets and strings. A generally rectangular fingerboard mounts the strings and frets in a generally intersecting relationship thereon. The strings are tuned by string tensioning means, including tuning pegs. The string vibrations are amplified by an amplifier and sensed by a magnetic pickup. The strings and frets each define a number of notes, equal to at least the number of notes of an octave. In a first scheme of modulation, a plurality of strings are played along a single fret in a manner similar to a piano, the octave and key linear distance spacings as well as notes, being emulated. In a second scheme of modulation, different frets are played to obtain different notes, as in a guitar, to achieve a wide tonal range with easy fingering positions. Vertically adjustable magnets pick up the vibrations and are able to change the vibration sensitivity of the instrument.

17 Claims, 5 Drawing Figures

STRINGED MUSICAL INSTRUMENT

BACKGROUND OF THE INVENTION

1. Field of the Invention

The present invention relates generally to musical instruments of the type that utilize vibrating strings to produce sounds. More particularly, the invention relates to an instrument in which the strings of such a musical instrument can be tuned in a predetermined temperament to produce a musical sound.

2. Description of the Prior Art

Since the dawn of history, many civilizations have adopted and used a series of musical intervals to define a musical scale. The musical scale is comprised of musical intervals between a successive pair of fundamental frequencies. Each fundamental frequency is accompanied by many harmonic frequencies. The musical interval (I) is defined, in equal temperament music, as being one-twelfth of the natural log of 2, i.e., $I=\ln 2/12$. The piano is tuned in equal temperament. Other proportional musical intervals between successive fundamental frequencies do exist. Indian music, for example, often uses an interval of one twenty-forth of the natural natural log of 2, i.e., $I=\ln 2/24$.

Be it Greek, Indian or modern western music, all civilizations have agreed that a multiple between two fundamental frequencies of 2 or 3/2 is pleasing to the ear. The musical intervals corresponding thereto are ln 2 and (ln 3 − ln 2), the latter interval being called a fifth. It is from these musical intervals, and some others, that Pythagoras developed a musical scale.

None of the twelve successive notes of a diatonic scale, another relatively modern scale, are equally spaced between the preceding and succeeding note on the musical scale. In playing the diatonic scale, the ratios involved are simpler than those of the Pythagorian scale but nonetheless remain irregular. Since the time of Pythagoras much work has gone into developing the scale in order to include additional notes. The modern equal temperament musical scale therefore includes twelve notes as in the diatonic scale. In the modern scale there are twelve notes from the first note to its reappearance, defining an octave.

In an attempt to closely approximate the notes of a diatonic scale, the equal temperament scale for piano tuning and playing has exactly a one-twelfth difference between each succeeding note in the scale. The relatively recent development of even or equal temperament tuning has greatly simplified matters in modern music, but, due to difficulties in retuning, has lost to us many of the pleasant melodies and harmonies that existed in older music, particularly music of the type played on such instruments as the harpsichord, lyre and lute. A stringed instrument that can be easily tuned to different temperaments is not presently available.

Heretofore, a musical instrument combining the method of play and range of the piano with the capability of the guitar to extend the tonal range of a given string by the use of frets, has not been known. Relatively large stringed instruments, such as shown in U.S. Pat. No. 4,249,449 to R. Armstrong, are known. Armstrong's instrument is a musical instrument adapted for play by more than one person at a time. The musical instrument is playable by hands, picks or hammer-like devices. The use of the fingers to strike the strings is not specifically shown in Armstrong. Frets are shown in combination with the strings. The strings extend radially away from each other begining from a central open area to the outer edge of the instrument so that a number of persons can play the instrument simultaneously.

A stringed musical instrument played like a guitar, but without a sound box is formed from a piece of wood and a few strings and is known as a "stick". The "stick" is played by depressing a string into contact with a fret, much in the manner of a guitar. A "stick" is described in U.S. Pat. No. 3,833,751 to Chapman, wherein each of nine strings is tuned in a specific way, some strings being tuned relative to certain other strings.

A foot operated musical instrument is shown in U.S. Pat. No. 4,024,787 to H. Larson. Larson describes the placement of the strings in contact with the frets as a way of actually playing the instrument. The strings are therefore not plucked but rather depressed by a foot of the musician into contact with laterally extending frets. Conventional magnetic pickup means sense vibrations of the string and convert them into electrical signals which are in turn fed to an amplifier.

U.S. Pat. No. 2,906,158 to J. McBride shows a stringed instrument of the percussion type wherein a plurality of laterally extending frets are upwardly moveable in so as to strike all longitudinally extending strings simultaneously. A keyboard instrument which simulates many of the sound characteristics of the electric guitar is shown in U.S. Pat. No. 4,156,380 to T. Fulton.

OBJECTS AND SUMMARY OF THE INVENTION

It is the principal object of the present invention is to provide a stringed musical instrument that can be played in a manner similar to a piano but by direct finger contact on a string rather than on a key.

It is another object of the present invention to provide a stringed musical instrument which can be played in manner similar to a piano, but having a tonal range on a given string equivalent to that available on a guitar.

It is a further object of the present invention to provide a stringed musical instrument with two modes or schemes of modulation, instead of a single mode such as in a piano, one mode providing a constant relationship between strings no matter the temperament in which the strings are tuned, and a second mode of modulation, in which additional tonal range and methods of play are achieved by use of frets.

It is still a further object of the present invention to provide a stringed musical instrument with a magnetic pickup associated with the strings, the magnetic pickup adjustably movable with respect to the strings to thereby vary the sensitivity of the pickup.

In accordance with the foregoing objects, a stringed musical instrument embodying the present invention incorporates a first modulation scheme similar to that of a piano wherein, once tuned in one key, the instrument may be played in tune in any other selected key. In a second modulation scheme, the instrument embodying the present invention is playable like a piano but, like a guitar, has additional tonal ranges achieved through the use of frets, which frets are easily reached for higher and lower notes from a given hand and finger position. The stringed instrument accomplishes these unique features by a matrix of at least thirteen strings extending longitudinally along the length of a fingerboard, and at least thirteen frets extending laterally beneath each one of the thirteen strings. The thirteen strings represent an octave, each string being separated by a semitone from the next adjacent string. In a like manner, the frets intersecting a given string ascend in semitones for an octave when a string is sequentially depressed into contact with the frets. The strings are passed across a bridge and are secured to the fingerboard by appropriate tensioning means. Adjustment of the string tension to provide various temperaments is inherent in the invention.

The stringed instrument is played by depressing a string into contact with a fret. The resulting sound produced by string vibration is picked up by sensing means, such as magnetic pickup devices, and fed through conventional amplification circuits to produce the sound.

DESCRIPTION OF THE PREFERRED EMBODIMENT

Figure 1:
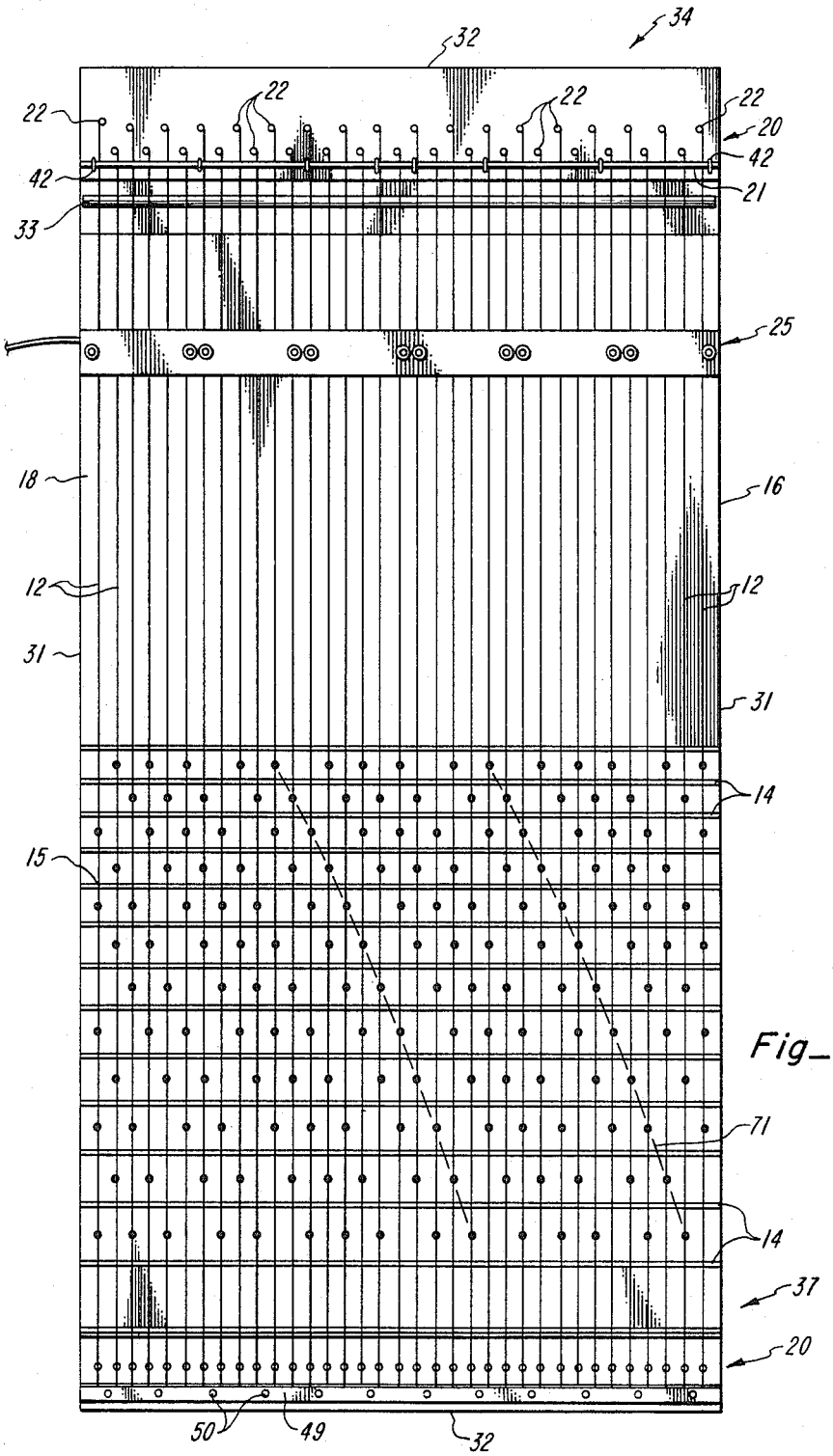
FIG. 1 is a top view of a stringed musical instrument embodying the present invention.

A stringed musical instrument 10 embodying the present invention is shown in the drawings. The instrument is played primarily as one would play a piano, except that the user's fingers directly strike strings 12. The instrument 10, is formed on a rigid fingerboard 16. The fingerboard 16 is made of hardwood, plywood, graphite, fiberglass or the like and includes a pair of parallel generally elongated side edges 31 and a pair of generally parallel laterally extending end edges 32. One illustrative fingerboard 16 is of thirteen ply rock maple piano pin plank board, one and five-eigths inches thick by nineteen inches wide by thirty-four and a half inches long.

A bridge end 34 of the fingerboard 16 (FIG. 2) supports a bridge 33 and tensioning means 20, including tuning pegs 22, for adjusting the tension and thereby the tuning strings 12. A spring tension rod 21 is also a part of the tensioning means 20 at the bridge end 34. A recess 40 in the fingerboard extends laterally between the two side edges 31 of the fingerboard 16 in a belly or top surface 18 of the fingerboard 16, and mounts the bridge 33 transversely to the strings 12. The bridge 33 is positionable along the width of the bridge recess 40 to thereby assist in establishing the desired tension in the strings 12. The metal bridge 33 shown is of circular transverse cross section of length equal to that of the bridge recess 40.

Figure 2:
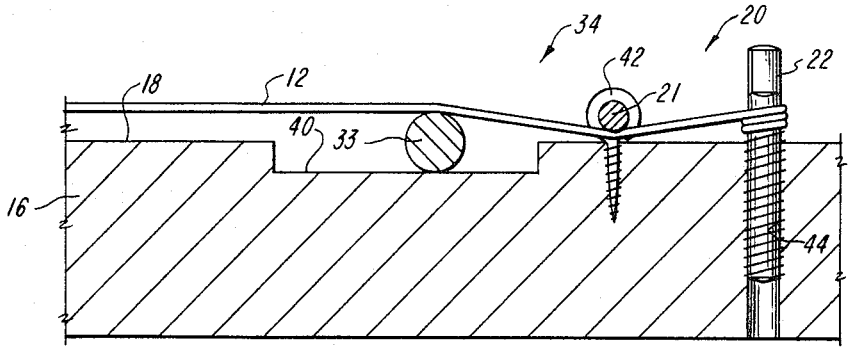
FIG. 2 is an enlarged fragmentary sectional view of a bridge end of the instrument shown in FIG. 1.

Intermediate the bridge 33 and the bridge end 34 of the fingerboard 16 is positioned the metal spring tension rod 21, which spring rod 21 is of circular transverse cross section extending between the side edges 31 of the fingerboard 16. The spring tension rod 21 is held in position by eight ring head screws 42 secured in the top surface 18 of the fingerboard 16 across the width thereof as seen in FIGS. 1 and 2. As seen in FIG. 2, the string tension rod 21 is positioned in contact with and passes over all the strings 12. A plurality of bores 44 perpendicular to the top surface 18 are formed between the mounting position of the spring tension rod 21 and the edge 32 of the bridge end 34 of the fingerboard 16. One bore 44 is formed in the fingerboard 16 for each string 12 of the instrument 10, each bore 44 receiving in a threadable arrangement the conventional tuning peg 22 to which peg 22 one end of each string 12 is secured. Turning the peg 22 into the bore 44 winds the string 12 onto the peg and accordingly tightens the tension in the string 12. The tuning peg 22 comprises a portion of the tensioning or tuning means 20 of the musical instrument 10.

The instrument 10 is played at a fretted end 37 (FIG. 3) of the fingerboard 16. The fretted end 37 includes a fine tune mechanism 23, in the form of a leather plug or bead 24 slidable under each of the strings 12. The leather plug 24 is also part of the tensioning means 20 for the instrument 10. The plug 24 is in contact with the top surface 18 of the fingerboard 16.

Frets 14 are mounted in slots 38 formed in the top surface 18 of the fingerboard 16 at the fretted end 37. Each of the strings 12 passes over the frets 14, which are used in conjunction with the strings 12 to produce musical sounds. Intermediate the first and second frets 19 of the fretted end 37 is a felt strip 45 extending laterally from one side edge 31 to the other side edge 31 of the fingerboard 16. The felt strip 45 defines damping means for the strings 12 and keep them from ringing.

Figure 3:
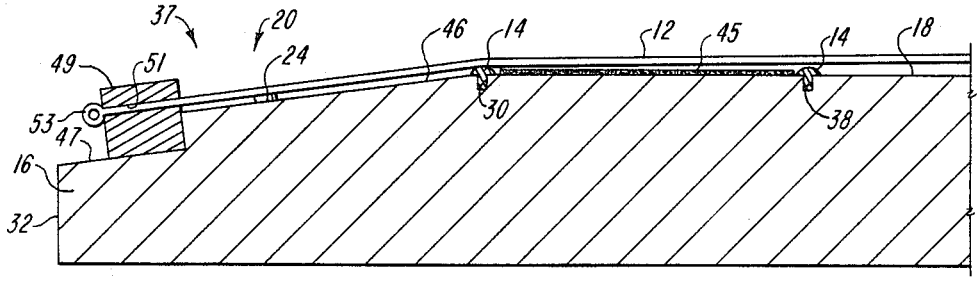
FIG. 3 is an enlarged fragmentary sectional view of a fretted end of the instrument shown in FIG. 1.

The fretted end 37 of the fingerboard 16 terminates in a downwardly sloping taper 46. In a notch of a surface of the taper 46 at the end edge 32 is mounted a string retainer 49 shaped like an elongate beam of rectangular cross section. The string retainer 49 is secured by screws 50 to the surface 47. The string retainer 49 has a plurality string bores 51 formed transversely therethrough to receive the strings 12. The strings 12 have at one end an integral ring 53. In a conventional manner the ring 53 abutts the string retainer block 49 as seen in FIG. 3, The string 12 passes through the bores 51 and is attached at the other end to the tuning peg 22.

Figure 5:
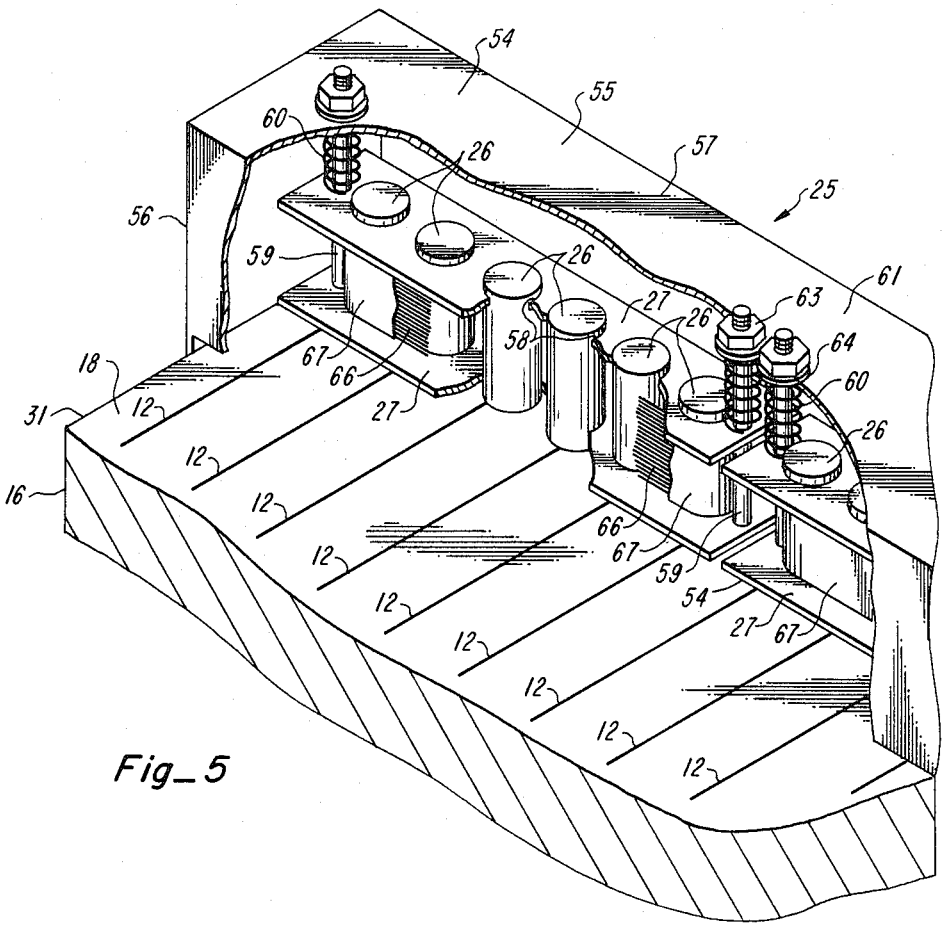
FIG. 5 is a partial fragmentary perspective view of a support for a magnetic pickup assembly on the instrument shown in FIG. 1.

For purposes of picking up and amplifying string vibration, an electromagnetic sensing and amplification assembly 25 is provided. Adjacent the bridge end 34 of the fingerboard 16 there is mounted a number of magnetic pickup assemblies 54 (FIG. 5). The pickup assemblies 54 are carried by a support 55 formed of a pair of side brackets 56 secured to either side edge 31 of the fingerboard 16 which side brackets 56 are interconnected by an integral laterally extending channel member 57. The channel member 57 is supported at an elevated position above the strings 12, the opening in the channel 57 facing the top surface 18.

As shown in FIG. 5, each of the pick up assemblies 54 include a set of six cylindrical magnets 26, mounted within the opening of the support 55. A magnet 26 is provided for each string 12 of the instrument 10. The magnets 26 are connected in groups of six between a pair of flat planer pieces of fibreboard 27, each group of six defining one of the pick up assemblies 54. Each piece of fibreboard 27 has six holes 58 formed therein on centers that are spaced from each other the same distance as the strings 12 are spaced. The holes 58 receive the magnets 26, which are glued in relative position to the fibreboard 27.

For purposes of changing the sensitivity of the instrument 10, means are provided for raising and lowering the magnets 26 relative to the strings 12. To this end, both ends of the fibreboard 27 have additional holes through which an elongate mounting screw 59 passes. The mounting screw 59 is secured to the channel member 57 by a nut 63 and axially supports an elongated spring 60 intermediate an upper one of the fibreboards 27 and an interior surface of the opening in the channel member 57. An exterior surface 61 of the channel member 57 has the nut 63 positioned adjacent thereto secured to the mounting screw 59, which screw 59 passes through mounting holes 64 in the channel member 57. Turning the pair of nuts 63 associated with a group of six magnets 26 of one of the magnetic pick up assemblies, changes the distance between the magnet 26 and the strings 12. The spring 60 biases the fibreboard 27 and magnets 26 downwardly toward the string 12. In this manner, by raising or lowering the magnets 26 relative to the strings 12, the sensitivity of the instrument 10 to the vibrating strings 12 can be changed.

Each group of six magnets 26 forming a pickup assembly 54 is wound with wire 66 to a resistance of approximately 5000 ohms. The fibreboards 27 and wire 66 are wrapped in copper foil 67. In a conventional manner, the direction of winding the wire 66 is alternately reversed in each group of magnets 26 forming a pickup assembly 54. Pickup assemblies 54 are electrically coupled through conducting wires and conducted to RCA plugs, which are in turn conducted to an amplifier (not shown).

A playing area matrix 15 is formed by the intersecting strings 12 and frets 14. As shown in the drawings, there are thirteen frets 14, defining an octave therebetween, and thirty-five strings 12. A minimum preferred embodiment would include thirteen strings 12 defining an octave and thirteen frets 14 also defining an octave.

In a first modulation scheme, the instrument 10 is tuned on open strings into any temperament desired by the musician. The instrument 10 is then played on a given fret 14 in any desired key. When the key of play, or fret 14, is changed the instrument 10 remains in tune with the selected temperament. The musician, who stands or sits at one end of the instrument 10, which instrument 10 is supported on a stand (not shown), plays strings 12 along a given fret 14 by striking them, percussing the strings 12. The selected temperament can be the modern equal temperament, or an older temperament more suited for playing compositions originally composed for such instruments as the harpsichord or lute. As long as the strings 12 along a given fret 14 are played, a given melody is played in a key corresponding to the fret 14, e.g., C sharp. Changing the fret 14 played will change a key to a higher or lower key while maintaining the tuning as originally set on the open strings being played.

In a second modulation scheme, the instrument 10 is played on different frets 14. In this second mode of modulation, the fingerings are normally the same as those of the piano, but additional notes can be reached more easily than possible with piano fingerings by moving up or down the string 12 and contacting a different fret 14 to reach a specific note. The instrument 10 is played, as in the first mode, like a piano with respect to the fingering movements. The strings 12 and frets 14 are each a half step or semitone apart. As with a guitar, a higher or lower note can be reached by striking a given string 12 at a higher or lower fret 14. In playing certain compositions or melodies, the fingering movements thus are easier than those required for playing a piano.

The two schemes of modulation of the instrument 10 are available by reason of the generally rectangular matrix 15 made up of the intersecting strings 12 and frets 14. The strings 12 and frets 14 are mounted on a fingerboard 16, the strings 12 extending longitudinally along the length thereof at a spaced distance above the top surface or belly 18 of the fingerboard 16. The frets 14 are mounted in and extend laterally across the top surface or belly 18 of the fingerboard 16. The strings 12 are directly struck or played with the musicians' fingertips as one would would play the keys of a piano. Depressing a string 12 into contact with a fret 14 induces a vibration in the string 12 which in turn produces music. The tensioning means 20 (FIGS. 2 and 3) are provided at either end 34 and 37 of the instrument 10 for adjusting the temperament of the strings 12. The sensing and amplification means 25 (FIG. 5) are provided to pick up and then amplify the sound produced by striking a finger against a string 12 and fret 14.

With respect to the strings 12, the linear distance across the instrument 10 from octave to octave is the same as it is on a conventional piano. The linear distance between adjacent strings to string is not exactly the same as the linear distance between adjacent white keys on a piano, but is the same as the linear distance between adjacent black keys on a piano. The strings 12 are tuned so that there is a half step or semitone interval between adjacent strings, just as in the keying of a piano. The thirteen frets 14, defining the twelve notes of the modern musical scale, are similarly each a half step apart in ascending order from the fretted end 37 of the musical instrument 10 to the bridge end 34.

Figure 4:
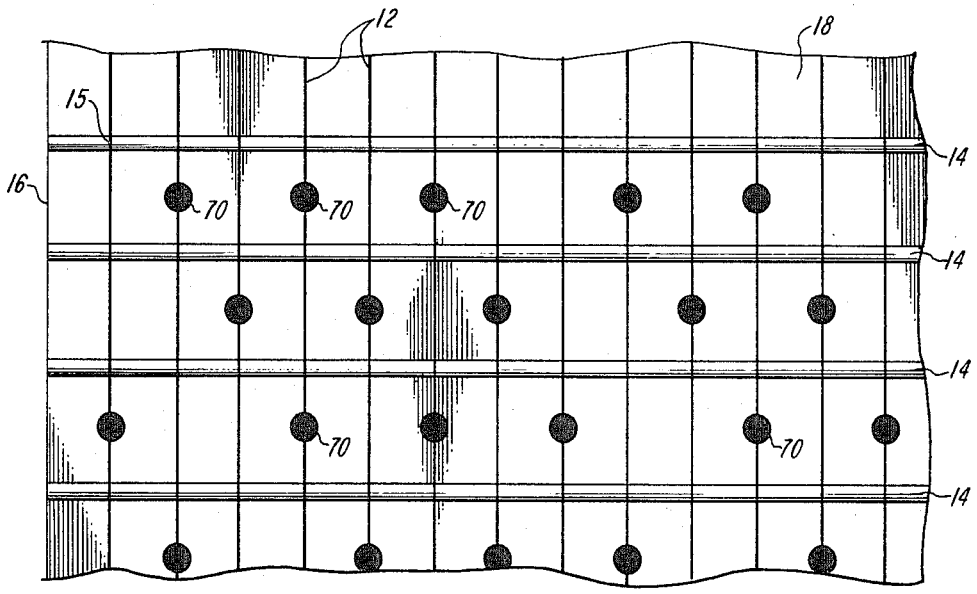
FIG. 4 is a fragmentary enlarged plan view, similar to FIG. 1, showing a dot pattern for a first and a second modulation scheme for the instrument shown in FIG. 1.

As shown in FIG. 4 a musical scale one octave wide, from F sharp to F sharp, is established by the strings 12 of the musical instrument 10. Playing the strings on a single fret 14 provides the musician with a first scheme of modulation wherein the musical instrument 10 is played in a manner similar to a piano, both hands being used while the instrument 10 is supported by a stand (not shown).

Position dots 70 are inlaid between the frets 14 and just under the strings 12 (FIGS. 1 and 4). The position dots 70 extend across the width of the fingerboard 16 between adjacent frets 14. Moving up a fret 14 finds a position dot 70 corresponding to the same note moved a string 12 to the left. The dots 70 are positioned above each string 12 to correspond to both the linear position and note associated with a black piano key. No dots appear for white keys. The position of the fingers in relation to the dots 70 will be exactly the same everywhere on the musical instrument 10 for the same notes, no matter if the modulation is up or down, right or left, from a given position. As seen in FIG. 1, by moving up and to the left to a dot 70, the same note is played. The dots 70 connected by an arcuate imaginary line 71 (FIG. 1) are each the same note.

The musical instrument 10 is first coarsely tuned by use of a piano hammer (not shown) and the tuning peg 22. Fine tune adjustment is provided by the tensioning means 20, specifically using the sliding leather plug 24.

In a second embodiment of the invention, the matrix 15 of the strings 12 and the frets 14 can be used as a synthesizer interface. Each fret 14 and each string 12 is connected to electrical conductors. Electrical contact between a string 12 and a fret 14 would complete a circuit which would be decoded by a matrix decoder and sent to triggering circuits for oscillators, ADSR generators and the like.

In a third embodiment of the invention, the bridge 33 is moved back and a moveable steel bar (not shown)

placed over the string 12 at the true bridge position. Movement of the steel bar back and forth cause a smooth change in pitch of the entire instrument 10. This would give rise to many novel bending effects such as obtained on steel guitars and synthesizers. Although the invention has been described with certain degree of particularity, nothing contained herein should serve to limit the scope of the invention as defined in the appended claims.

What is claimed is:

1. A musical instrument played by a musician in a manner similar to a piano comprising, in combination, a fingerboard of generally rectangular plan view with a matrix of laterally extending continuous frets and overlying longitudinally extending strings mounted on said fingerboard, each of said frets passing beneath and thereby associated with all of said strings and each of said strings passing over and thereby apsociated with all of said frets, each of said frets musically spaced so that the difference in pitch between adjacent frets associated with a given string is one half step up or one half step down, said strings physically spaced so that twelve consecutive strings are the same physical distance apart as an octave on a piano keyboard, each of said strings being adapted to be depressed into contact with any one of said frets to produce a vibration in said strings, a first scheme of modulation obtained by user of all of the strings in association with a single fret, said strings being previously tuned on open string to a selected temperament, which string temperament remains the same as a different fret is played, or a second scheme of modulation wherein said tuned strings are played in combination with more than a single fret to achieve higher and lower notes.

2. An instrument as defined in claim 1 wherein said instrument further includes means for sensing and amplification of string vibrations.

3. An instrument as defined in claim 2 wherein said sensing and amplification means comprises:

a laterally extending support mounted on said fingerboard at a position above said strings;

a wire wound magnet associated with each string, said magnet mounted on said support; and means for interconnecting said magnets to a sound amplifier.

4. An instrument as defined in claim 3 further comprising means for adjustably mounting said magnets relative to said strings for adjustment of the sensitivity of said magnets to said vibrating strings with respect to said strings.

5. An instrument as defined in claim 3 wherein:

said support includes a channel with mounting holes formed therein, at least one of said magnets connected to at least one rectangular planer board, said board having means for adjustment passing through holes formed therein, each of said adjustment means passing through the holes in said support and having a spring axially supported thereon between said board and said support channel, and a nut threadably connected to said screw on an exterior surface of said channel.

6. An instrument as defined in claim 1 wherein said instrument further includes means for tensioning said strings, said tensioning means comprising a string retainer at one end of said fingerboard for engaging an end of each of said strings, a tuning peg at the opposite end of said fingerboard for engaging the opposite end of said string, and a spring tension rod secured to the fingerboard and passing over said strings intermediate said retainer and said tuning pegs.

7. An instrument as defined in claim 6 further including a fine tune mechanism.

8. The instrument as defined in claim 1 wherein said fingerboard has a lateral recess therein, and a bridge positioned in said lateral recess, said string passing over said bridge

9. The instrument as defined in claim 1 wherein the linear distance between selected strings for a given fret corresponds to the linear distance between black piano keys, and position dots on the fingerboard identify said selected strings, whereby the fingerings of the instrument are similar to those of a piano.

10. The instrument as defined in claim 1 wherein said fingerboard includes finger position dots placed on said top surface, said dots defining indicia for strings corresponding to the musical spacing of black piano keys.

11. A stringed musical instrument for simulating the play of a piano comprising in combination:

a generally rectangular fingerboard;

a plurality of continuous frets underlying a plurality of strings defining a matrix of intersecting frets and strings, and strings being mounted on said fingerboard above said frets, each of said strings being tuned a semitone apart from each adjacent string and said frets being musically spaced to form an ascending semitone scale of at least an octave, said instrument including at least thirteen strings and frets, whereby depressing one of said strings into contact with said frets vibrates said string to produce sound.

12. The instrument as defined in claim 11 wherein said fingerboard has position dots under certain strings, said strings over said dots spaced the same linear distance as between black keys of said piano and corresponding to the same musical note as each of said black keys.

13. The instrument as defined in claim 11 further comprising a bar movable over said strings at a preselected position to produce music.

14. A musical instrument played by a musician by contacting strings of the instrument in a manner of play similar to a paino, comprising in combination:

a generally rectangular fingerbard having a top surface with a plurality of parallel frets mounted on said top surface and extending continuously across the width of said fingerboard, continuous longitudinally extending strings mounted on said fingerboard at a spaced distance above said frets and said top surface, a string vibration being induced by depressing one of said strings into contact with said frets, said strings being musically spaced apart at half steps with respect to a given fret to define at least a semitone scale of at least one octave, said strings being mounted on said fingerboard by tensioning means for varying the tension in each of said strings to obtain a desired musical temperament, and sensing and amplification means for first sensing a vibration produced in one of said strings and then increasing the sound produced by the vibration of said string.

15. An instrument as defined in claim 14 wherein said sensing and amplification means comprises: a laterally extending support mounted on said fingerboard at a position above said strings to support a plurality of wire wound magnets, each of said magnets associated with one of said strings, and means for conductively connecting each coil with a sound amplifier.

16. An instrument as defined in claim 15 further comprising means adjustably mounting said magnets on said support to thereby vary the distance between said magnet and said string.

17. An instrument as defined in claim 15 wherein said support includes a channel having mounting holes therein, at least one of said magnets connected to at least one rectangular planar board, said board having mounting screws passing through holes formed therein, each of said screws having a spring axially mounted thereon between said board and interior opening in said channel, fastening means threadably connected to said screw on an exterior surface of said channel through said mounting holes whereby rotating said fastening means raises or lowers said magnets with respect to said strings.

* * * * *